US007913400B2

(12) United States Patent
Larkin

(10) Patent No.: US 7,913,400 B2
(45) Date of Patent: Mar. 29, 2011

(54) COMPACT BOLT CUTTER WITH IMPROVED MECHANICAL ADVANTAGE

(76) Inventor: John Arthur Larkin, Swansea, MA (US)

( * ) Notice: Subject to any disclaimer, the term of this patent is extended or adjusted under 35 U.S.C. 154(b) by 549 days.

(21) Appl. No.: 11/981,361

(22) Filed: Oct. 31, 2007

(65) Prior Publication Data

US 2008/0163494 A1 Jul. 10, 2008

Related U.S. Application Data

(60) Provisional application No. 60/879,485, filed on Jan. 9, 2007.

(51) Int. Cl.
*B26B 17/00* (2006.01)

(52) U.S. Cl. ..... 30/248; 30/187; 30/235; 30/312; 30/252; 30/193

(58) Field of Classification Search ..... 30/180, 30/187, 188, 177, 245, 249, 250, 272.1, 190, 30/191, 193, 491, 312, 235, 248, 340–341; 29/261, 268; 81/395, 399; 83/600
See application file for complete search history.

(56) References Cited

U.S. PATENT DOCUMENTS

| | | | | | |
|---|---|---|---|---|---|
| 492,931 | A * | 3/1893 | Baird | 30/180 |
| 500,184 | A * | 6/1893 | Beers | 30/187 |
| 1,592,017 | A * | 7/1926 | Campen | 30/180 |
| 1,882,218 | A * | 10/1932 | Harvey | 30/261 |
| 2,398,209 | A * | 4/1946 | Clemens | 81/350 |
| 2,939,211 | A * | 6/1960 | Daniels | 30/187 |
| 2,956,340 | A * | 10/1960 | Levenson | 30/272.1 |
| 3,138,869 | A * | 6/1964 | Parhaniemi | 30/187 |
| 3,949,473 | A | 4/1976 | Blanc | |
| 4,069,582 | A * | 1/1978 | Kearns | 30/182 |
| 4,868,986 | A * | 9/1989 | Olson et al. | 30/193 |
| 5,014,432 | A | 5/1991 | Putsch | |
| 5,862,597 | A | 1/1999 | Juros | |
| 5,898,998 | A | 5/1999 | Deville | |
| 6,971,179 | B2 * | 12/2005 | Erbrick | 30/191 |
| 7,621,052 | B1 * | 11/2009 | Kerr | 30/188 |
| 7,690,119 | B1 * | 4/2010 | Weber | 30/193 |

* cited by examiner

*Primary Examiner* — Laura M. Lee

(57) ABSTRACT

(FIG. 1) shows an improved bolt cutting tool comprising left and right cutting jaws (10) that are closed by handles (12A and 12B). As handles (12A and 12B) are separated, jaw (10) opens to allow the material to be cut to enter. The cutting handles (12A and 12B) are closed, utilizing a partially threaded rod (14) and rotational handle (16) to draw them closed. (FIG. 2).

11 Claims, 4 Drawing Sheets

10 A
10 B
10
25
12 A
12 B
16
14
18
20
13 B
13 A

COMPACT BOLT CUTTER WITH IMPROVED MECHANICAL ADVANTAGE

CROSS-REFERENCE TO RELATED APPLICATIONS

This application claims the benefit of provisional application Ser. No. 60/879,485, filed 2007 Jan. 9 by the present inventor.

FEDERALLY SPONSORED RESEARCH

Not Applicable

SEQUENCE LISTING OR PROGRAM

Not Applicable

BACKGROUND

1. Field of Invention

This invention relates in general to bolt cutters but may also apply to other devices for cutting or punching.

2. Prior Art

A commonly used conventional device for cutting bolts, locks, and reinforcement bar is referred to as a bolt cutter. The standard bolt cutter is generally made up of two long handles connected to a pair of opposing jaws that can be manually separated or brought together by movement of the handles. The long handles enable the user to produce force at the jaws for cutting, usually smaller sized bolts. This embodiment relates to a bolt cutter, type cutting tool, specifically with an improved closing mechanism.

Originally bolt cutters were manufactured with relatively long handles to help the user generate the desired cutting force, as with U.S. Pat. No. 3,949,473 to Blanc (1976). However, many consumers are still unable to generate enough force to produce the desired cut. Thereafter, several other cutting tools have been proposed U.S. Pat. No. 5,862,597 to Juros (1999) discloses a cutter with an increased handle arc range that only slightly increased the mechanical advantage upon closing. U.S. Pat. No. 5,014,432 to Putsch (1991) discloses a handle arrangement that crosses over without joint increasing the cutting output, but still requiring the user to generate a substantial amount of force.

U.S. Pat. No. 5,898,998 to Deville (1999) discloses a cutting tool with emphasis on decreasing the thickness of the support members, producing a lighter tool but with still the cutting difficulties of previous cutters.

One of the disadvantages to the existing devices is that the handles have to be made extremely long and it is still difficult for the user to be able to produce sufficient cutting force. It is an object of the present invention to increase by simple means the cutting power produced while closing the more compact handles.

Also, existing devices are limited in their use to the force that can be applied directly by the user of the device. And so the amount of force generated for cutting is limited by the physical strength of the user. Further, the state of the art bolt cutters are heavy and cumbersome to use.

Accordingly, it is an object of the present invention to provide an improved bolt cutter with greater cutting force utilizing a substantially enhanced mechanical advantage thereto. So that cutting of relatively large hard work-pieces, such as bolts or reinforcing bars of steel can be effected with relative ease.

Still another object of the present invention is to provide a bolt cutter, that can be manufactured with a lighter, smaller more compact construction.

SUMMARY

The foregoing and other objects, features and advantages of the present invention can be realized by providing a cutting or punching apparatus having at one end a set of jaws and at the other end a relatively shorter length handles that are connected by a means for providing a mechanical advantage. In the disclosed embodiment herein this means includes a threaded rod that can be turned to close the handles and similarly close the jaws.

DRAWINGS

Figures

Numerous other objects, features and advantages of the present invention should now become apparent upon a reading of the following detailed description taken in conjunction with the accompanying drawings, in which.

REFERENCE NUMERALS

Figures 1, 1A, 1B:
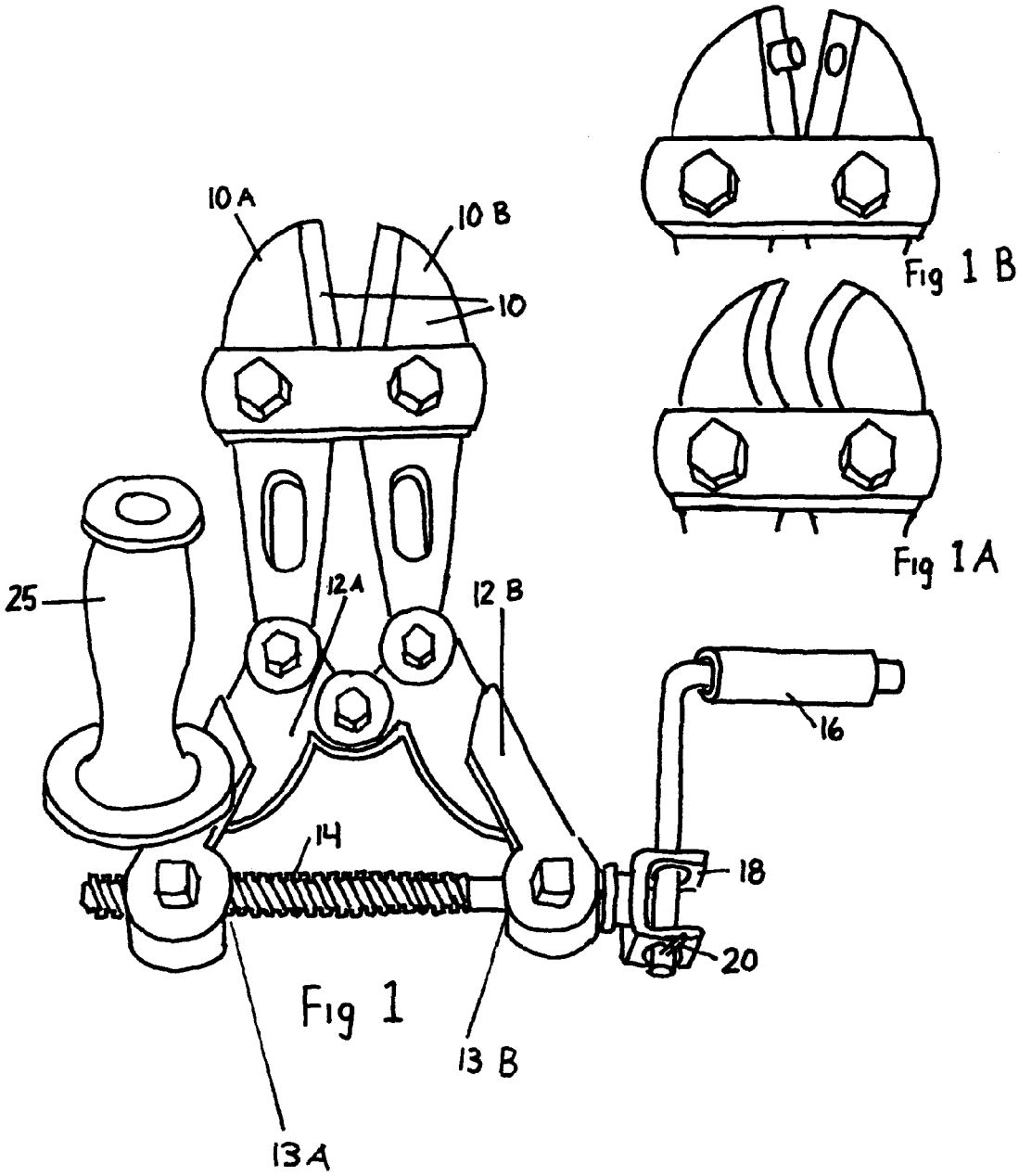
FIG. 1 is a first view of the device of the present invention shown in its open position.
FIG. 1A illustrates an alternate embodiment for the cutting end of the device.
FIG. 1B shows a further alternate embodiment at the distal end of the device for providing a punching action.

10 jaws
10A, 10B separate jaws
12A, 12B handles
13A threaded hole 13B through-hole
14, 14A threaded rod
15 arrows
16 rotational handle
18 yoke
20 pin
25 holder
28 hex head
29 central drive engagement
30 ratchet handle

DETAILED DESCRIPTION

FIGS. 1, (1A & 1B), 2, 3 and 4A and 4B

Reference is now made to the drawings illustrating one possible embodiment of the cutting tool of the present invention. As indicated previously, this tool can be used for cutting such as the cutting of bolts or can be used for cutting cables, locks, reinforcement bar or can even be used for a punching operation. The device is basically comprised of a set of jaws 10 including separate jaws 10A and 10B. Each of these jaws has a cutting blade and is supported for pivotal operation from the handles 12A and 12B. The basic cutting blades and handles 12A and 12B are like that found in existing instruments except that handles 12A and 12B are quite short in comparison to the conventional bolt cutter. When handles 12A and 12B are in a more open position such as shown in FIG. 1, this corresponds to an open position of cutting jaws 10.

Figure 3:
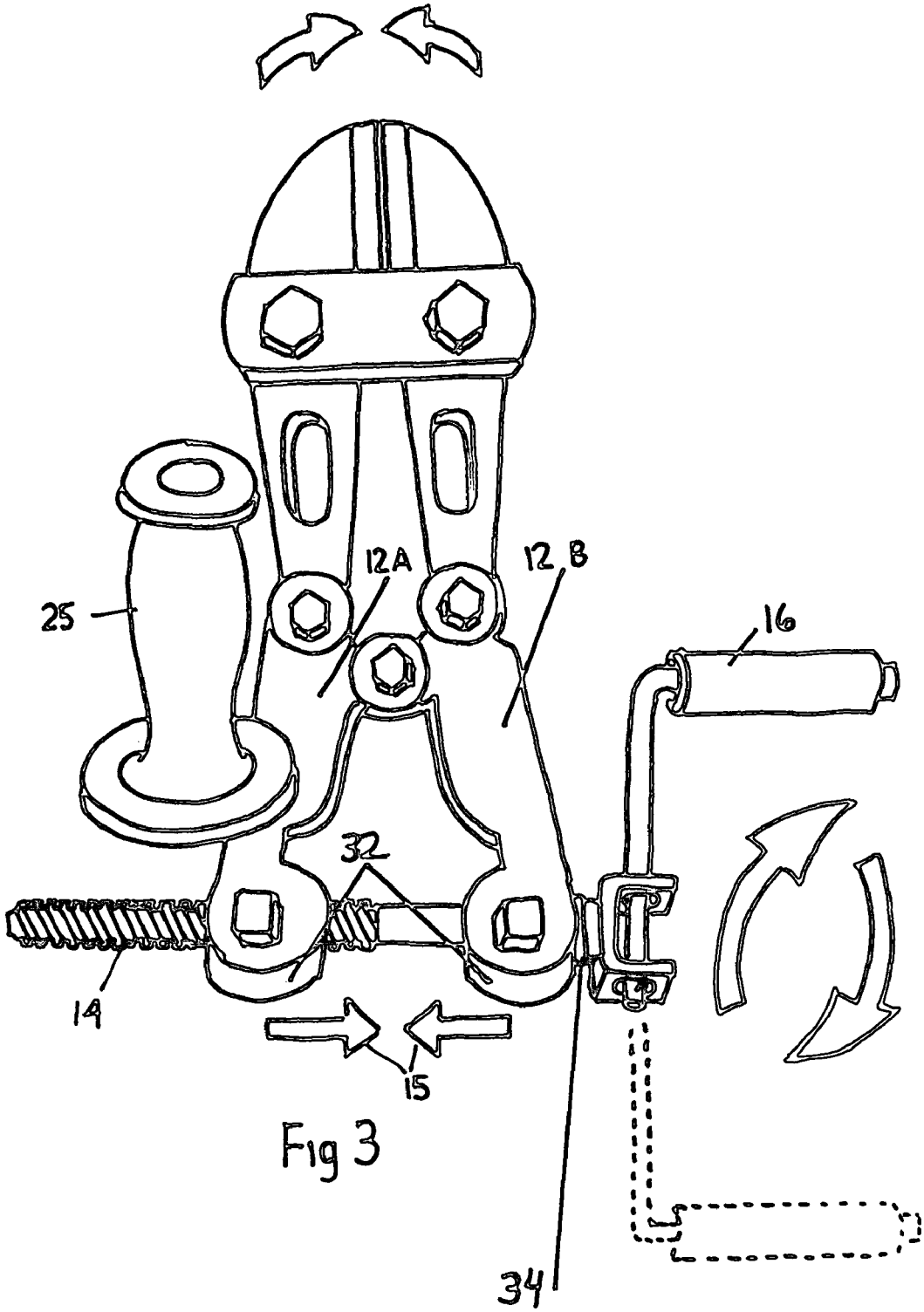
FIG. 3 is a view similar to that shown in FIG. 2 and illustrating the applied force.

At the base of handles 12A and 12B there is provided a tightening, lead or threaded rod 14 that functions similar to a jack for drawing handles 12A and 12B together such as illustrated by the arrows 15 in FIG. 3. For this purpose the end of 12A may be provided with a threaded hole 13A for receiving threaded rod 14. The free end of handle 12B supports the other end of threaded rod 14 by through-hole 13B. I presently contemplate that a rotational handle 16 be used to rotate threaded rod 14, however, in other embodiments, as in FIG. 4B threaded rod 14A is rotated by a centrally located ratchet handle 30. The rotation of threaded rod 14 in turn causes handles 12A and 12B to move either together or apart. The threads on threaded rod 14 may be either left or right hand threads. Further, the number of threads per inch on rod 14 can also be altered to produce the desired cutting force.

Figure 2:
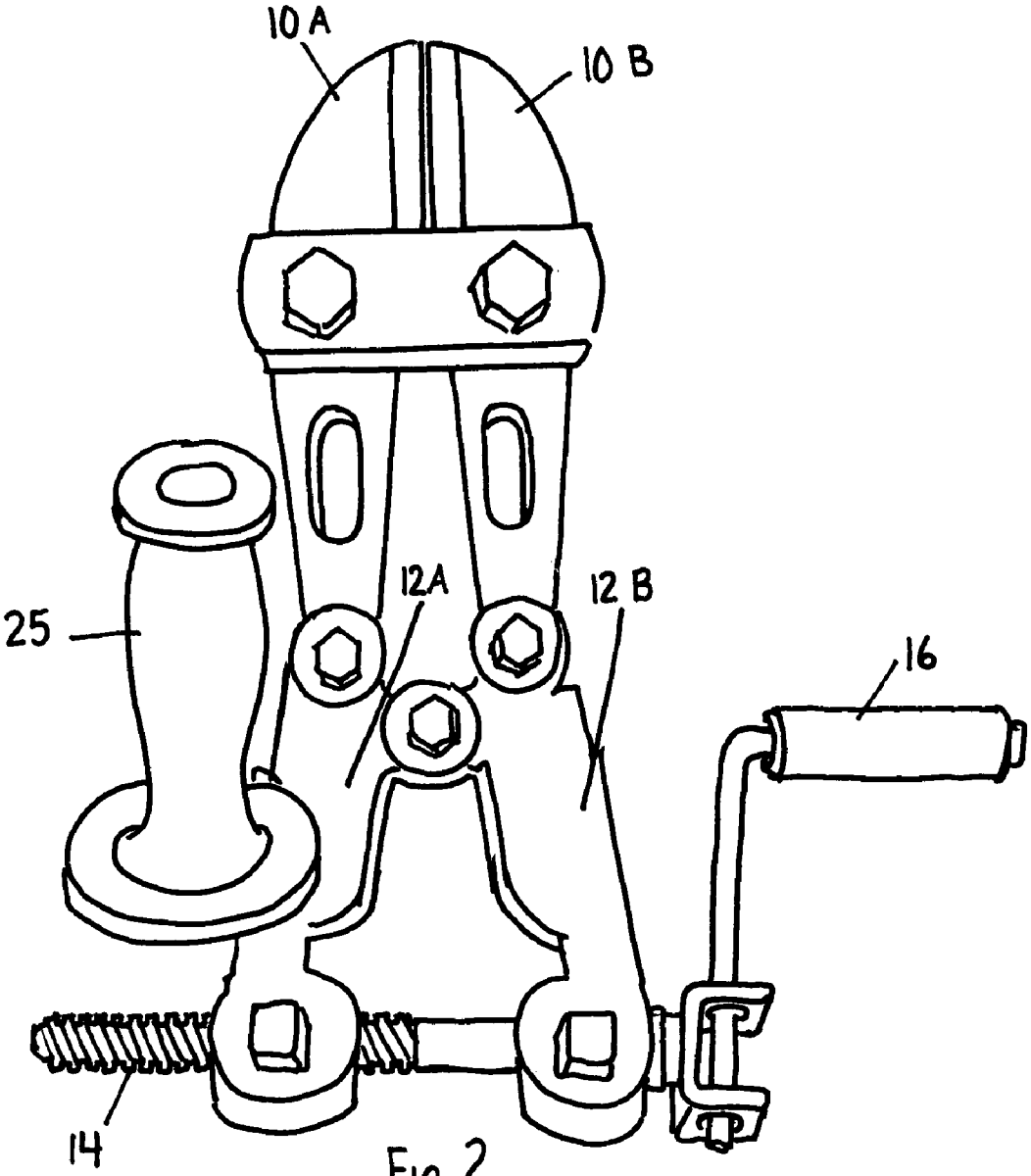
FIG. 2 is a view similar to that shown in FIG. 1 but with the jaws closed.

Rotatable handle 16 is secured at the yoke 18 such as by means of pin 20 which may be a cotter pin. The combination of handle 16 and threaded rod 14 associated with handles 12A and 12B provides a substantial mechanical advantage in closing jaws 10 such as from the position shown in FIG. 1 toward the position shown in FIG. 2.

The drawings also show a holder 25 that may be screwed into one of the handles such as into illustrated handle 12A. Holder 25 is preferably engageable on either side of handle 12A or may be engageable with handle 12B depending upon whether the instrument is being held by a left or right handed person. Holder 25 assists in holding and stabilizing the instrument during operation.

Figure 4A:
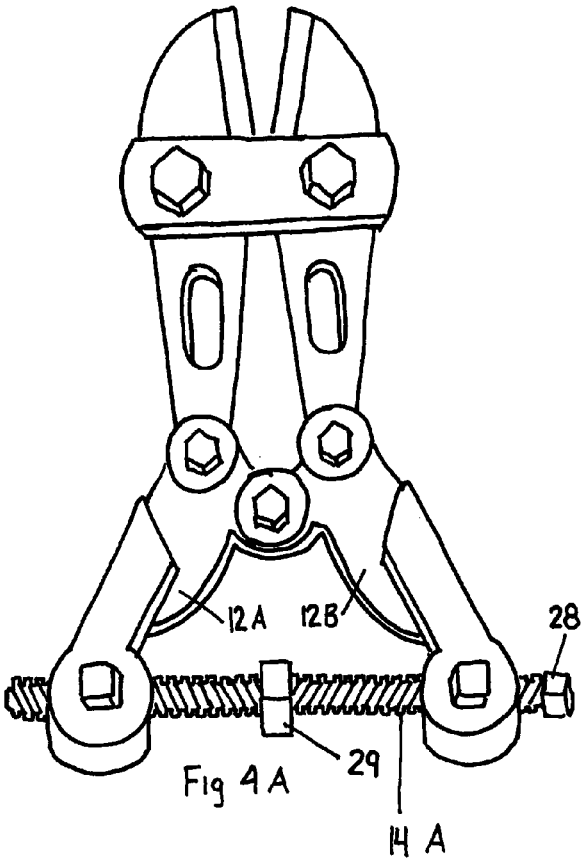
FIG. 4A and FIG. 4B show alternate embodiments at the proximal end of the device supplying the rotational force.

As indicated previously, rotation handle 16 may be removed by removing cotter pin 20. This enables one to operate threaded rod 14 in other manners. For example, there may be provided a hex head 28 and if yoke 18 is removed then hex head 28 can be used with a socket, wrench or ratchet to rotate threaded rod 14A. Also, at either end of threaded rod 14 or 14A there may be provided a means for receiving a drive drill or other motorized drive apparatus for driving threaded rod 14 under operator control. FIG. 4A also shows an alternate location for a drive engagement 29. The threads on threaded rod 14A are comprised of opposing left and right threads, enabling the centrally located attachment to draw handles 12A and 12B together.

The means provided which includes either threaded rod 14 or 14A for closing handles 12A and 12B of the instrument provides a substantial mechanical advantage over an operator manually operating handles 12A and 12B. This can provide at least one order of magnitude of force greater than is able to be applied by merely manually closing the handles directly. This arrangement, by shortening the length of handles 12A and 12B, also provides a far more compact and easily operable bolt cutting arrangement.

As indicated previously, the distal end of the instrument may also be constructed in different manners. Refer to FIG. 1A and FIG. 1B for illustrations of different cutting arrangements. FIG. 1A represents arcuate blades for cutting cables rather than the straight surface as shown in FIG. 1, and FIG. 1B refers to a punching arrangement that may be comprised of a male and a female member. This may be used for punching holes in, for example, steel plate. In either FIG. 1A or FIG. 1B the mechanisms are closed in a similar manner to that illustrated in FIGS. 1-4.

Having now described a limited number of embodiments of the present invention, it should be apparent that numerous other embodiments and modifications thereof are contemplated as falling within the scope of the present invention. For example, mention has been made of the use of a motorized drive for threaded rod 14 or 14A. This motorized drive may be provided at either end of threaded rod 14 or the center of threaded rod 14A. Also, other forms of drive members may be engaged with threaded rod 14 or 14A in addition to the use of hex head 28.

Operation

FIGS. 1, 2, 3 and 4A and 4B

The bolt cutter comprises left and right cutting jaws 10 that are closed by handles 12A and 12B. As handles 12A and 12B are separated, the jaws open to allow the material to be cut to enter. As handles 12A and 12B are closed utilizing threaded rod 14 or 14A to draw them closed, the cutting edges of jaws 10 close and cut the inserted material. The improved mechanical advantage provided by threaded rod 14 or 14A allows any user to generate the needed cutting force. Thus, the tool is not limited by the physical strength of the user. The substantially enhanced mechanical advantage allows for the cutting or punching of relatively large hard workpieces, such as bolts or reinforcing bars of steel with relative ease.

Another advantage of the embodiment is a bolt cutter that is less cumbersome and can be manufactured with a much more compact construction than the traditional bolt cutters.

Alternative Embodiment

FIG. 4

Figure 4B:
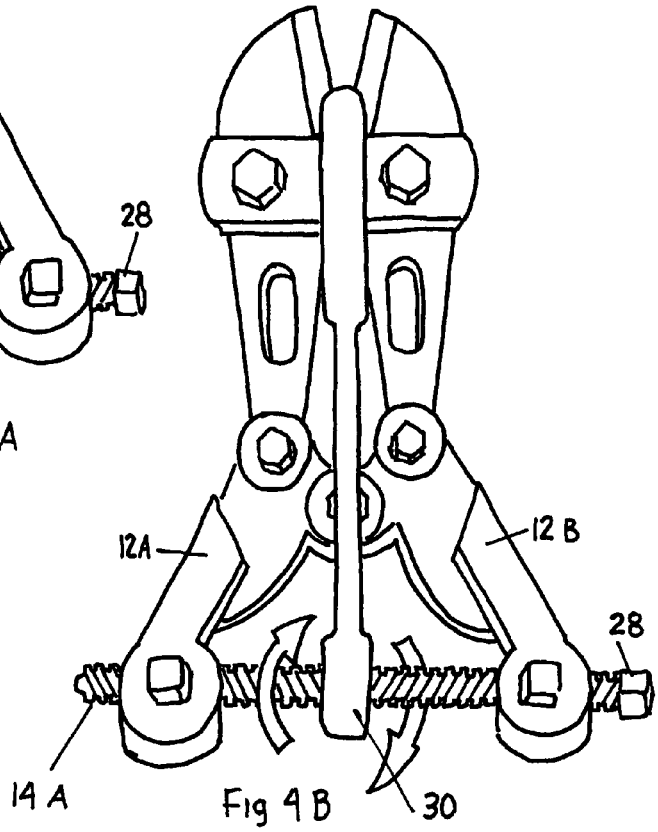

Additional embodiments are shown in FIG. 4A and FIG. 4B. FIG. 4A shows a centrally located drive engagement. In FIG. 4B threaded rod 14A is shown with centrally located ratchet handle 30, for this embodiment threaded rod 14A would have opposing right and left hand threads on either side of centrally located ratchet handle 30 to produce the desired closing of handles 12A and 12B.

Advantages

From the description above, a number of advantages of some embodiments of my compact bolt cutter become evident:

(a) The threaded rod design provides a substantial mechanical advantage when closing the handles.
(b) The enhanced mechanical advantage allows for much shorter handles than a traditional bolt cutter.
(c) The cutting force generated by the tool is not limited by the physical strength of the user.
(d) It is lighter, less cumbersome and can be manufactured with a more compact construction.
(e) The balance and physical safety of the operator is not jeopardized using this new and extremely controlled cutter.
(f) This device eliminates the need for multiple persons to produce the necessary cutting force.
(g) It is a valuable tool for enclosed or hazardous locations.

CONCLUSION, RAMIFICATIONS, AND SCOPE

Accordingly, the reader will see that the bolt cutter of the various embodiments is much less cumbersome and easier to use than any of the traditional bolt cutters. The cutting force generated by the enhanced mechanical advantage makes it more widely usable, as it is not limited by the physical strength of the user. The relative ease and speed in which it cuts makes it a valuable tool to commercial institutions, fire and rescue teams. Its simplistic design can be easily manufactured and adds a new dimension to the bolt cutting market.

Although the description above contains many specificities, these should not be construed as limiting the scope of the embodiment but as merely providing illustrations of some of the presently preferred embodiments.

Thus the scope of the embodiment should be determined by the appended claims and their legal equivalents, rather than by the examples given.

I claim:

1. A cutter for cutting bolts comprising:

a first handle having a first end and a second end;

a second handle having a first end and a second end, one of the first or second handles having a laterally extending threaded hole at the second end; the other of the first or second handles having a laterally extending through-hole at the second end, and the first handle and second handle connected at a pivot between the first ends and the second ends of the handles;

a first jaw and a second jaw having opposing first and second cutting blades, the first jaw connected at the first end of the first handle and the second jaw connected at the first end of the second handle;

a partially threaded rod having a longitudinal axis that extends through the threaded hole and the through-hole, wherein the threaded portion of the rod mates with the threaded hole and the non-threaded portion of the rod is engaged with the through-hole, and a yoke is attached to the non-threaded end of the rod;

the partially threaded rod extending perpendicularly to both the longitudinal axis of the cutter and the pivot axis, a rotation handle having a first portion and a second portion, the first portion extending substantially parallel with the threaded rod, and the second portion extending perpendicularly to the first portion;

the second portion of the rotation handle extending through the yoke;

a holder attached to either the first handle or the second handle and extending substantially parallel to the pivot axis;

wherein rotation of the rotation handle about the longitudinal axis rotates the partially threaded rod, drawing the handles together, and pivoting the jaws to impart a cutting action to a bolt.

2. The cutter of claim 1, wherein the threads of the partially threaded rod are right hand threads.

3. The cutter of claim 1, wherein the threads of the partially threaded rod are left hand threads.

4. The cutter of claim 1, wherein the holder is screwed onto the first or second handle.

5. The cutter of claim 1, wherein the first and second cutting blades have an arcuate cutting edge.

6. The cutter of claim 4, wherein the first and second cutting blades have an arcuate cutting edge.

7. The cutter of claim 1, wherein the first and second cutting blades have a straight cutting edge.

8. The cutter of claim 4, wherein the first and second cutting blades have a straight cutting edge.

9. The cutter of claim 1, wherein the second portion of the rotation handle is secured by a cotter pin to the yoke.

10. A method of cutting a workpiece with a tool comprising:

providing the cutter of claim 1;

gripping the holder and rotational handle, and orienting the jaws about the workpiece;

rotating the rotational handle about the longitudinal axis to draw the first and second handles and the first and second jaws together in order to sever the workpiece.

11. The method according to claim 10, wherein the workpiece is a bolt.

* * * * *